United States Patent [19]

Kao

[11] Patent Number: 4,967,498

[45] Date of Patent: Nov. 6, 1990

[54] PICTURE FRAME

[76] Inventor: Pei-Chin Kao, 3F1., No. 35, Ching Chung St., Ching Mei, Taipei, Taiwan

[21] Appl. No.: 298,678

[22] Filed: Jan. 19, 1989

[51] Int. Cl.[5] ..... A47G 1/06

[52] U.S. Cl. ..... 40/152; 40/154

[58] Field of Search ..... 40/152, 152.1, 154

[56] References Cited

U.S. PATENT DOCUMENTS

| | | | |
|---|---|---|---|
| 1,049,830 | 1/1913 | Elyovszky | 40/152 |
| 1,463,150 | 7/1923 | Carlsen | 40/152 |
| 1,926,909 | 9/1933 | Lilja | 40/152 |
| 2,785,490 | 3/1957 | Fabry | 40/152 X |
| 3,408,759 | 11/1968 | Rotheraine et al. | 40/152 |
| 4,393,612 | 7/1983 | Clark | 40/154 X |

*Primary Examiner*—Laurie K. Cranmer
*Attorney, Agent, or Firm*—Keaty & Keaty

[57] ABSTRACT

A picture frame having a channel on the front surface of a border, a slot on the rear surface of the border and a decorative plate engageable within the channel or the slot by engagement device. The channel has a number of annular holes formed on it, and the engagement member is substantially rectangular with a convex cross-section and a corresponding number of annular legs extending from it. The annular legs are engageable with the annular holes. The decorative plate is readily removable and is changeable with other decorations. The border further includes ferrous components so that small magnetic ornaments can be magnetically retained on the border.

2 Claims, 6 Drawing Sheets

PICTURE FRAME

BACKGROUND OF THE INVENTION

The present invention relates to picture frames, and in particular, to a picture frame comprising flexible engagement means having annular legs and a channel having annular holes through which a decorations can be engaged. In addition, the present invention provides other choices of engaging decoration plates.

Heretofore, decorations for picture frames have usually been integrated with the frame so that it is difficult, even impossible, to change the decoration to match other interior decor in one's house or office, or to better match the background of the picture itself.

It is therefore an object of the present invention to provide a modified picture frame of which the decoration is changeable.

SUMMARY OF THE INVENTION

It is a primary object of the present invention to provide a picture frame comprising flexible engagement means having annular legs and a channel having annular holes through which decoration parts can be engaged.

It is another object of the present invention to provide a picture frame having ferrous parts integrated therewith so that small ornamentations can be attached thereon by means of magnets.

It is still another object of the present invention to provide a picture frame of which the surface decorations are changeable.

It is yet another object of the present invention to provide a picture frame having different ways to engage decorations.

Other objects and advantages of this invention will be apparent to those having ordinary skill in the art when the following detailed description has been read in conjunction with the accompanying drawings.

BRIEF DESCRIPTION OF THE DRAWINGS

FIG. 5 is a cut-away exploded partially cross-sectional view showing engagement between engagement means and border in accordance with alternative embodiment of the present invention.

DETAILED DESCRIPTION OF THE PREFERRED EMBODIMENT

For purposes of promoting an understanding of the invention, reference will be made to the embodiments illustrated in drawings. It will, nevertheless, be understood that no limitation of the scope of the invention is thereby intended, such alternatives and further modifications in the illustrated device and such further application if the principles of the invention as illustrated herein being contemplated as would normally occur to one skilled in the art to which the invention relates.

Figure 1:
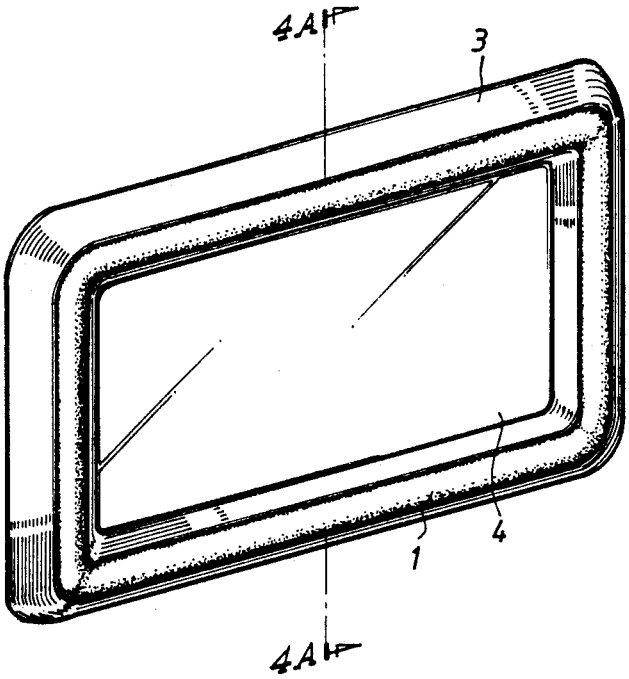
FIG. 1 is a perspective view of an embodiment of a picture frame in accordance with the present invention.
Figure 2:
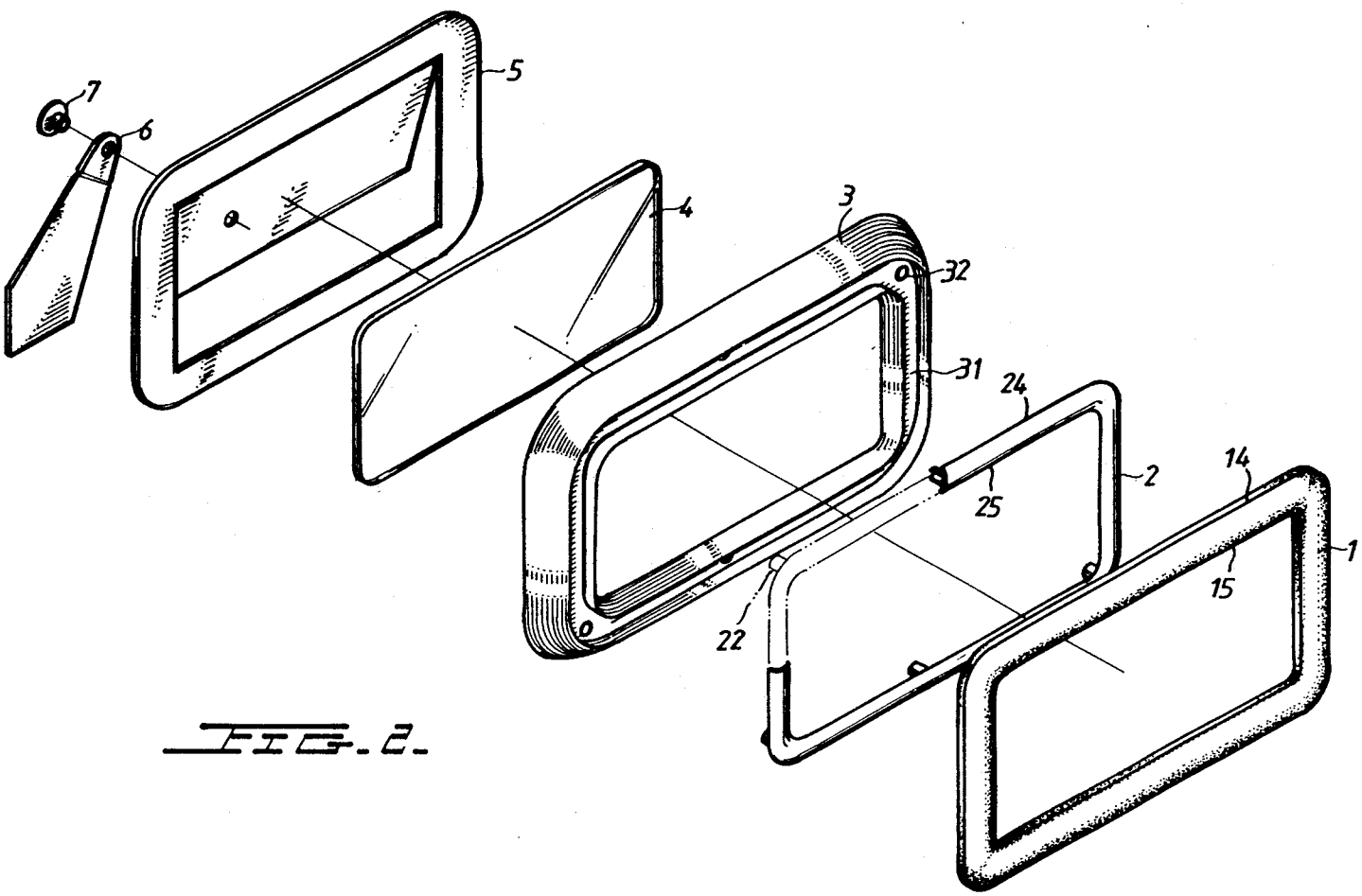
FIG. 2 is an exploded view of the embodiment of the picture frame of FIG. 1.
Figure 6:
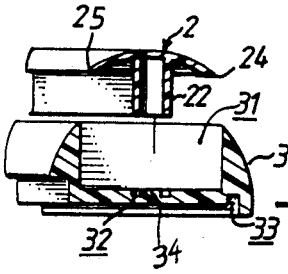
FIG. 6 is a cut-away exploded partially cross-sectional view showing engagement between engagement means and border in accordance with one embodiment of the present invention.
Figure 7:
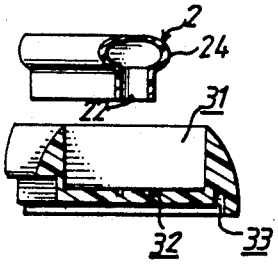

Referring now to FIGS. 1 and 2, a picture frame of the present invention comprises a border 3. A glass plate 4 is attached to rear side of the border 3 a back plate 5 is attached to a rear side of the glass plate 4 a support 6 is attached to a rear side of the back plate 5. The device is further provided with plate 1 and flexible engagement means 2. The border 3 substantially has a convex outer surface with a channel 31 provided along the front surface of the border 3. The channel 31 has plurality of annular holes 32 thereon. In one embodiment of the present invention each hole 32 of the channel 31 has a solid cylindrical tube 34 formed therein. The flexible engagement means 2 is substantially rectangular with a convex cross-section and a plurality of annular legs 22 extending therefrom. As can be seen in FIG. 6 and 7, each leg 22 has a hollow cylindrical shape. The flexible engagement means 2 may be engaged to the border 3 by fitting the legs 2 into the holes 32.

Figure 4B:
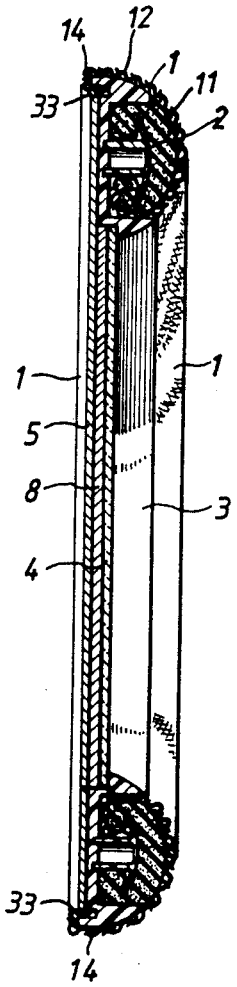
FIG. 4B is a cross-sectional view taken along line 4B—4B of FIG. 3.
Figure 4A:
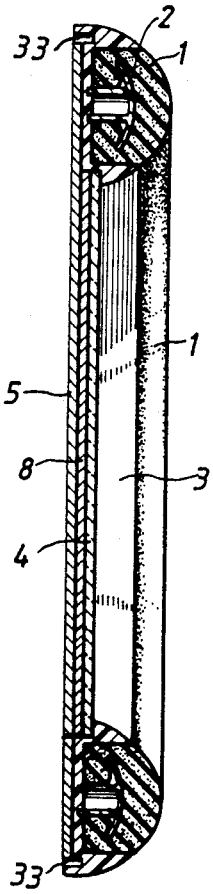
FIG. 4A is a cross-sectional view taken along line 4A—4A of FIG. 1.

Referring now to FIGS. 4A and 6 the flexible engagement means 2 has an inner peripheral edge 25 and an outer peripheral edge 24, with the width of the engagement means 2 being smaller than the width of the channel 31. In this manner, a clearance is formed between the parallel side walls defining the channel 31 and the inner 15 and outer 14 peripheral edges of the engagement means 2. Still, as can be seen in FIG. 2, the width of the decorative plate 1 is greater than the width of the engagement means 2, so that when decorative plate is secured to the border 3, the inner peripheral edge 15 of the decorative plate 1 deformably fits between the wall of the channel 31 and the engagement means 2 in the clearance formed by these elements, while the outer peripheral edge 14 of the decorative plate 1 deformably fits in the clearance formed between the other side wall of the channel 31 and the outer peripheral edge of the engagement means 2. At the same time, the legs 22 of the engagement means 2 are received within the holes 32 formed in the channel 31.

The decorative plate 1 is held tightly in the channel 31 due to the elasticity of the flexible engagement means 2 and can be removed and replaced by other decorative plates as desired by the user.

On the back of side of the border 3, a glass 4, a picture 8 and a back plate 5 are sequentially superposed on the border 3 in a known manner. The drawings show one of the manners.

Figure 3:
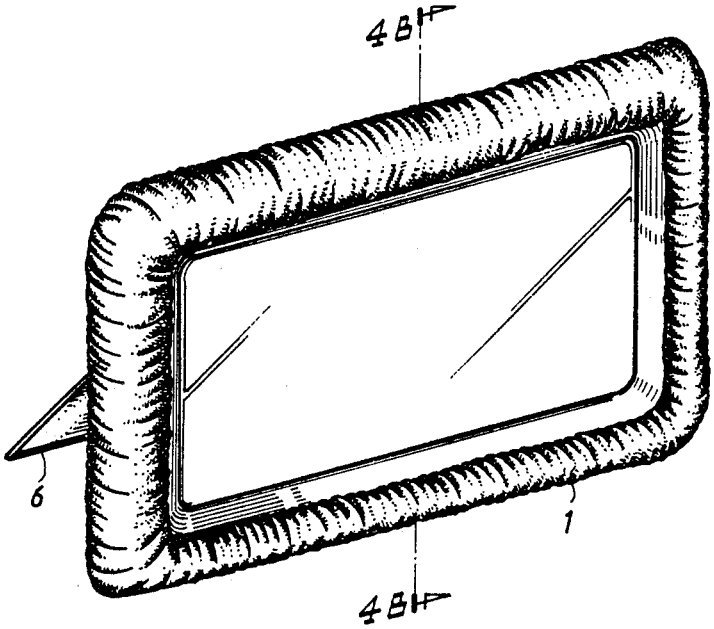
FIG. 3 shows another embodiment of a picture frame in accordance with the present invention.

Referring now to FIGS. 3 and 4B, an alternative method of securing the decorative plate 1 to the border 3 is illustrated. As can be seen in the drawings, a peripheral slot 33 is formed in the rear side of the border 3. When securing the decorative plate 1, the inner peripheral edge 15 of the plate 1 is deformably fitted in the clearance formed between the side wall of the channel 31 and the inner peripheral edge 25 of the engagement means 2. The outer peripheral edge 14 of the plate 1 is stretched and fitted into the slot 33. In this manner, the decorative plate 1 entirely covers the exterior front surface of the border 3 (see FIG. 3). As will be appreciated, the decorative plate 1 has an elastic rubber band sewn therein to ensure the decorative plate 1 is secured inside the slot 33.

As can be further seen in FIG. 4B, the decorative plate 1 can be made of two layers: inner layer 11 and outer layer 12. The inner layer 11 would be secured within the channel 31. The outer layer 12 would be secured along its inner peripheral edge in the channel 31, while it will be secured along its outer peripheral edge in the slot 33, covering and overlapping the inner layer 11. In this manner, a greater selection for decorating the picture frame is provided.

As shown in FIG. 2, it is also possible to add a support 6 on the back plate 5 by means of a screw 7. Since thses methods are all known, no further description will be necessary herein.

Figure 5:
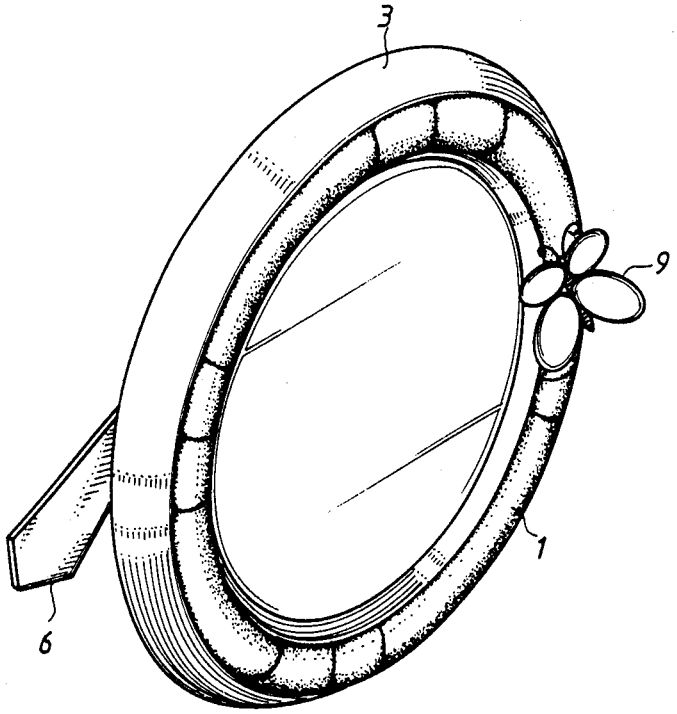
FIG. 5 shows yet another embodiment of a picture frame in a accordance with the present invention.

Referring now to FIG. 5, another preferred embodiment is shown. The border is circular and also has a convex outer surface. The decorative plate 1 is cut into pieces. A user can make other combinations from the decoration pieces to change the decorative pattern.

FIG. 5 illustrates another embodiment of the picture frame. The frame is round and a magnetic ornamental decoration 9 can be attached on the decoration plate 1. In this particular embodiment, the engagement means 2 is formed from a material containing iron, so that the magnetic decoration 9 can be retained on the decoration plate 1 by means of the magnetic force passing through the decoration plate 1.

Although this invention has been described with a certain degree of particularity, it will be understood that the present invention disclosure is made by way of example only and that numerous changes in the detail of construction and the combination and arrangement of parts may be resorted to without departing from the spirit and the scope of the invention as hereinafter claimed.

I claim:

1. A picture frame, comprising:

a border having a peripheral front border channel formed on a front side thereof, said channel being provided with a plurality of annular holes;

a glass plate attached to a rear side of the border;

a back plate attached to a rear side of the glass plate;

a support attached to a rear side of the back plate;

a flexible engagement means having a front surface; a plurality of cylindrical legs perpendicularly extending from a rear surface, of the flexible engagement means said legs being detachably engageable within the annular holes of the border front channel, said flexible engagement means having an inner peripheral edge and an outer peripheral edge, said flexible engagement means being adapted to fit into said front border channel, so that a clearace is formed between each peripheral edge of the flexible engagement means and side walls of the front border channel;

a decorative plate attached to a front side of the border in covering relationship to said engagement means, said decorative plate having an inner peripheral edge which fits in the clearance between a side wall of the front border channel and the inner peripheral edge of the flexible engagement means and having an outer peripheral edge which fits in the clearance between the side wall of the front border channel and the outer peripheral edge of the flexible engagement means.

2. The picture frame of claim 1, wherein said border is further provided with a peripheral rear side slot, and an outer peripheral edge of the decorative plate is alternatively fitted within said slot, while the inner peripheral edge of said decorative plate is retained within said front border channel.

* * * * *